US012013205B2

(12) United States Patent
McPherson et al.

(10) Patent No.: US 12,013,205 B2
(45) **Date of Patent: *Jun. 18, 2024**

(54) ARCHERY BOW RISER WITH ACCESSORY CAVITY

(71) Applicant: MCP IP, LLC, Sparta, WI (US)

(72) Inventors: Mathew A. McPherson, Norwalk, WI (US); Brandon J. Gann, Sparta, WI (US); Mark J. Hayes, Onalaska, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/388,150

(22) Filed: Nov. 8, 2023

(65) Prior Publication Data

US 2024/0077275 A1 Mar. 7, 2024

Related U.S. Application Data

(63) Continuation of application No. 17/707,757, filed on Mar. 29, 2022, now Pat. No. 11,885,588.

(60) Provisional application No. 63/167,511, filed on Mar. 29, 2021.

(51) Int. Cl.

| | |
|---|---|
| ***F41B 5/14*** | (2006.01) |
| ***F41B 5/00*** | (2006.01) |
| ***F41G 1/467*** | (2006.01) |

(52) U.S. Cl.

CPC ..... *F41B 5/148* (2013.01); *F41B 5/0031* (2013.01)

(58) Field of Classification Search

CPC .. F41B 5/00; F41B 5/0031; F41B 5/14; F41B 5/1403; F41B 5/148; F41G 1/467

USPC ..... 124/86, 87, 88; 33/265

See application file for complete search history.

(56) References Cited

U.S. PATENT DOCUMENTS

| | | | | | |
|---|---|---|---|---|---|
| 2,909,167 | A | * | 10/1959 | Fredrickson | F41B 5/143 124/25.7 |
| 3,406,675 | A | * | 10/1968 | Fredrickson | F41B 5/14 124/25.7 |
| 3,491,739 | A | | 1/1970 | Scrobell | |
| 4,452,222 | A | | 6/1984 | Quartino et al. | |
| 4,759,337 | A | * | 7/1988 | Suski | F41B 5/143 124/44.5 |
| 4,788,961 | A | | 12/1988 | Toth | |
| 4,893,606 | A | | 1/1990 | Sisko | |
| 5,005,554 | A | | 4/1991 | Shepley et al. | |
| 5,072,716 | A | * | 12/1991 | Sappington | F41G 1/467 124/87 |
| 5,123,396 | A | | 6/1992 | Shepley et al. | |
| 5,400,764 | A | * | 3/1995 | Spolar | F41G 1/467 124/87 |
| 5,433,792 | A | | 7/1995 | Darlington | |
| 5,803,070 | A | | 9/1998 | Martin et al. | |
| 5,904,134 | A | | 5/1999 | Denbow | |
| 5,934,266 | A | * | 8/1999 | Martin | F41B 5/1426 124/88 |

(Continued)

*Primary Examiner* — Alexander R Niconovich
(74) *Attorney, Agent, or Firm* — Laabs Intellectual Property

(57) ABSTRACT

In some embodiments, an archery bow comprises a riser, a first limb, a second limb and a bowstring. The riser comprises a first rail, a second rail and a plurality of connecting members extending between the first rail and the second rail. The riser comprises an accessory cavity and an accessory is positioned in the cavity. A fastener attaches the accessory to the riser.

28 Claims, 8 Drawing Sheets

(56) References Cited

U.S. PATENT DOCUMENTS 5,944,004 A 8/1999 Goff et al.
6,085,736 A 7/2000 Osterhues
RE36,942 E 11/2000 Shepley, Jr. et al.
6,142,134 A * 11/2000 Meeks ..... F41B 5/143 124/44.5
6,430,822 B1 8/2002 Slates
6,568,382 B2 * 5/2003 Martin ..... F16B 21/165 403/322.2
6,889,683 B1 5/2005 Smith
6,895,676 B1 5/2005 Mendyk
6,925,721 B2 * 8/2005 Dietz ..... F41G 1/467 124/87
6,938,616 B2 9/2005 Walk
6,968,837 B1 * 11/2005 Shepley, Jr. ..... F41G 1/467 124/87
7,066,165 B2 * 6/2006 Perry ..... F41B 5/10 124/88
7,347,196 B1 3/2008 Shepley, Jr. et al.
7,958,881 B2 * 6/2011 Silverson ..... F41B 5/14 124/88
7,987,842 B2 * 8/2011 McPherson ..... F41B 5/148 224/916
7,997,261 B2 8/2011 Scaniffe
8,225,778 B2 7/2012 Walk et al.
8,347,870 B1 1/2013 Mahutga
8,408,195 B2 4/2013 McPherson
8,839,775 B2 9/2014 Wasilewski
9,400,154 B2 7/2016 McPherson
9,429,383 B2 8/2016 Martens
9,752,843 B2 9/2017 Garver et al.
10,024,630 B2 7/2018 Donovan
10,077,964 B2 * 9/2018 Summers ..... F41B 5/1403
10,295,296 B2 5/2019 Summers
10,330,424 B2 * 6/2019 Brown ..... F41B 5/1492
10,393,471 B2 * 8/2019 McPherson ..... F41B 5/1426
10,619,966 B2 * 4/2020 Ozanne ..... F41B 5/105
10,634,448 B2 * 4/2020 Brown ..... F41B 5/0031
11,293,716 B1 * 4/2022 Dahl ..... F41B 5/1426
11,549,784 B2 * 1/2023 Brown ..... F41G 1/467
11,885,588 B2 1/2024 McPherson et al.
2009/0107474 A1 * 4/2009 Silverson ..... F41B 5/14 124/88
2020/0208938 A1 * 7/2020 Brown ..... F41B 5/0005
2020/0340774 A1 10/2020 Summers
2021/0254923 A1 * 8/2021 Summers ..... F41B 5/143
2022/0276019 A1 * 9/2022 Summers ..... F41B 5/143
2023/0221094 A1 * 7/2023 Yan ..... F41G 1/467 124/87
2023/0243616 A1 * 8/2023 McPherson ..... F41B 5/148 124/88

* cited by examiner

ARCHERY BOW RISER WITH ACCESSORY CAVITY

CROSS-REFERENCE TO RELATED APPLICATIONS

This application is a continuation and claims the benefit of U.S. patent application Ser. No. 17/707,757, filed Mar. 29, 2022, which claims the benefit of U.S. Patent Application No. 63/167,511, filed Mar. 29, 2021, the entire content of each of which is hereby incorporated herein by reference.

BACKGROUND OF THE INVENTION

This invention relates to archery bows and accessories for archery bows. Archery bows are generally known and used to launch arrows. Archery bows are often fitted with various accessories, such as stabilizers, arrow rests, sights, vibration dampers, etc.

Although there is a general desire for a bow to be as small and light as possible, each accessory tends to add weight and bulk, increasing the profile of the bow. Some users remove accessories from a bow when the bow is being configured for travel or storage, for example to allow the bow to fit in a case. Certain accessories are more critical to bow accuracy than others, and the specific placement and orientation of the accessory with respect to the bow riser can be very important. When an accessory is removed and later reinstalled, the specific placement and orientation can change due to tolerances and clearances of parts. If an accessory is attached with multiple screws, even the order of tightening the screws can change the specific placement of the accessory.

There remains a need for novel archery bow structures that improve upon prior bow structures. There remains a need for archery bow systems that reduce the weight and profile of the bow. There remains a need for archery bow systems that allow an accessory to be removed and reinstalled in the same specific location.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a riser, a first limb, a second limb and a bowstring. The riser comprises a first rail, a second rail and a plurality of connecting members extending between the first rail and the second rail. The riser comprises an accessory cavity comprising an aperture through the first rail. The aperture comprises an asymmetrical shape.

In some embodiments, the riser comprises a fastener extending into the cavity. In some embodiments, the aperture comprises a first contacting portion and a second contacting portion arranged to contact a mounting bar positioned in the aperture. In some embodiments, the fastener is arranged to bias a mounting bar positioned in the aperture against the first contacting portion and the second contacting portion. In some embodiments, the first contacting portion comprises a flat surface. In some embodiments, the second contacting portion comprises an arcuate surface. In some embodiments, the fastener is oriented at a non-orthogonal angle to a bowstring plane. In some embodiments, the fastener is supported by a connecting member.

In some embodiments, the aperture comprises a first aperture and the accessory cavity comprises a second aperture through the second rail. In some embodiments, the second aperture has the same shape as the first aperture.

In some embodiments, a mounting bar comprising a trapezoidal cross-sectional shape is positioned in the cavity. In some embodiments, a fastener is engaged with the riser and contacts the mounting bar. In some embodiments, a single fastener comprises the only fastener contacting both the riser and the mounting bar.

In some embodiments, an archery bow comprises a riser and an accessory supported by the riser. The riser comprises a first rail and a second rail. The accessory extends through the first rail and contacts the second rail.

In some embodiments, the first rail comprises a first aperture and the accessory is positioned in the first aperture. In some embodiments, the second rail comprises a second aperture and the accessory is positioned in the second aperture. In some embodiments, the first aperture and the second aperture comprise the same shape. In some embodiments, a cross-sectional shape of an aperture is asymmetrical across a first axis. In some embodiments, the cross-sectional shape of the aperture is asymmetrical across a second axis that is orthogonal to the first axis.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
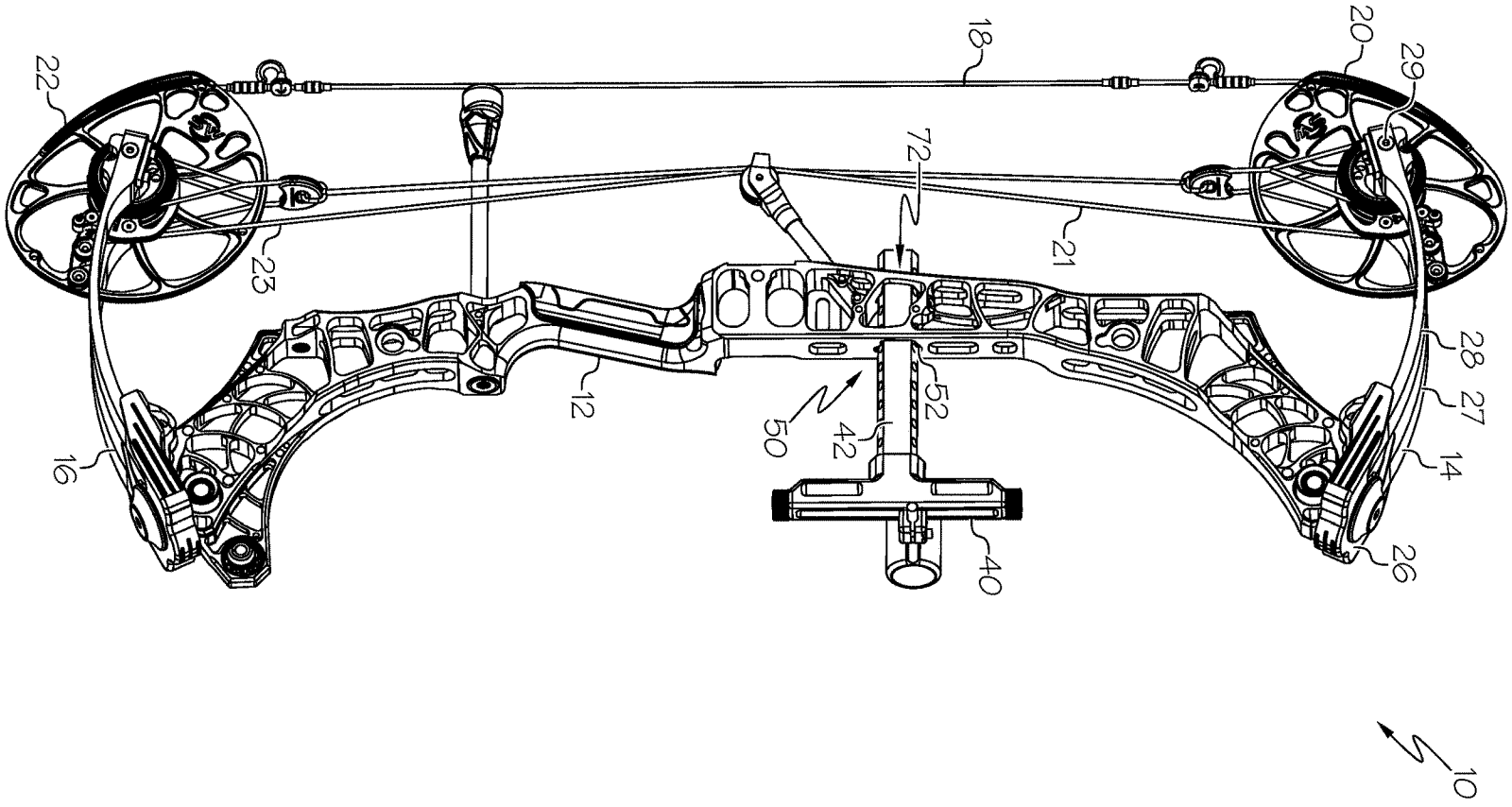
FIG. 1 shows an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the FIGS. shall refer to like features unless otherwise indicated.

Figure 2:
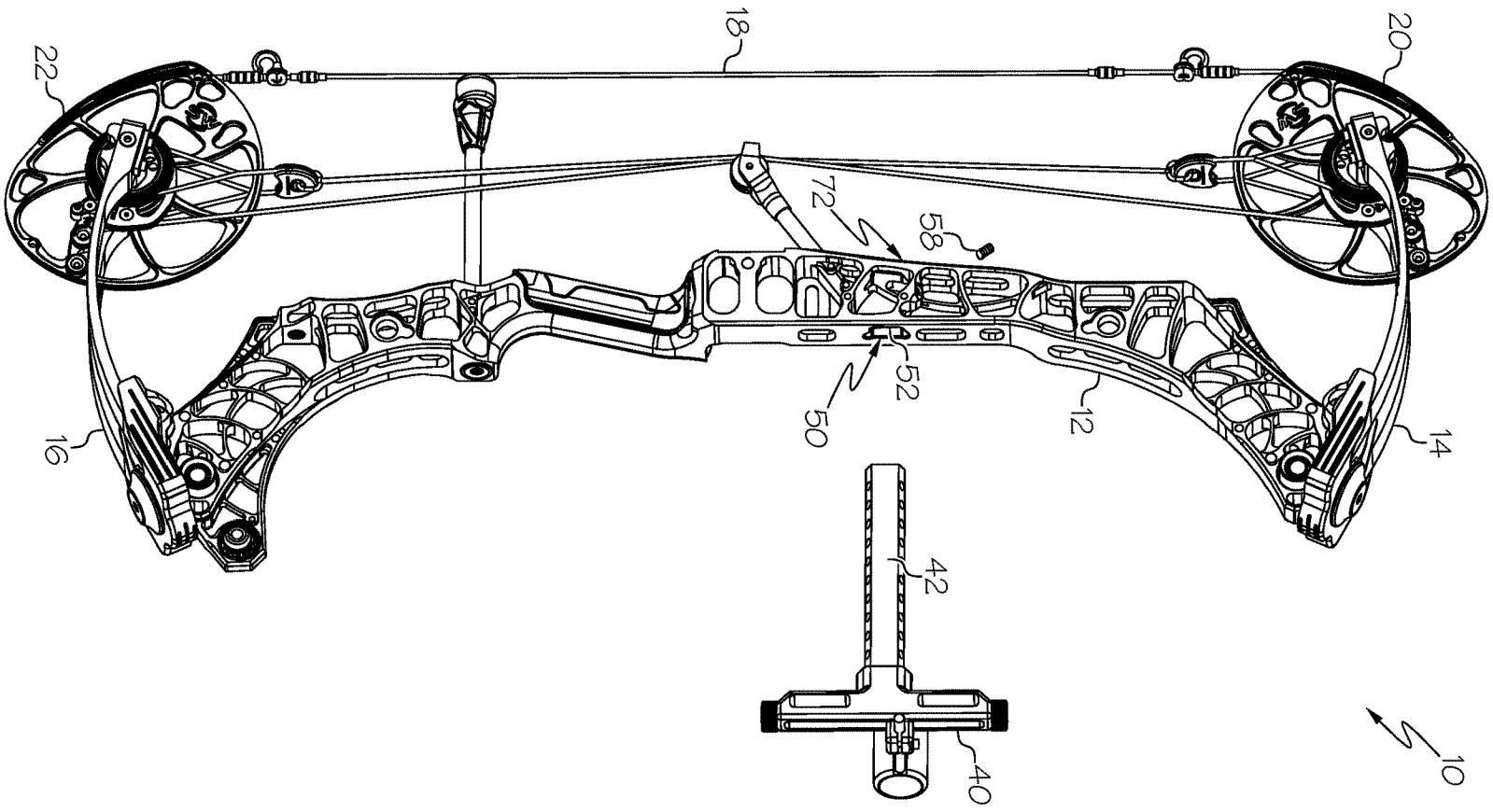
FIG. 2 shows the archery bow of FIG. 1 with an accessory detached.

FIGS. 1 and 2 show an embodiment of an archery bow 10. In some embodiments, an archery bow 10 comprises a riser 12, a first limb assembly 14, a second limb assembly 16 and a bowstring 16. In some embodiments, a limb assembly 14, 16 comprises a limb cup 26 arranged to support a limb member 27.

In some embodiments, an archery bow 10 comprises a compound bow comprising a first rotatable member 20, a second rotatable member 22, a first cable 21 and a second cable 23. In various embodiments, a compound bow can comprise any suitable type of compound bow, such as two-cam, single-cam, cam-and-a-half, etc.

In some embodiments, a limb assembly 14, 16 comprises a first limb member 27 and a second limb member 28 arranged to collectively support a rotatable member 20. In some embodiments, a limb assembly 14, 16 supports an axle 29 and the axle 29 supports a rotatable member 20.

In some embodiments, the riser 12 comprises a cavity 50 arranged to receive an accessory 40. In some embodiments, an accessory 40 comprises a sight. In some embodiments, an accessory 40 comprises a mounting bar 42 and the mounting bar 42 is oriented in the cavity 50. In some embodiments, a length of the mounting bar 42 is greater than a distance across the riser 12. In some embodiments, a mounting bar 42 positioned in the cavity 50 can protrude from the riser 12 on opposites sides of the cavity 50. In some embodiments, a first outer surface of the riser 12 comprises a first aperture 52 and a second outer surface of the riser 12 comprises a second aperture 72. In some embodiments, an accessory 40 can be attached to the riser 12 with a portion of the accessory 40 oriented in the first aperture 52 and another portion of the accessory 40 oriented in the second aperture 72.

In some embodiments, a fastener 58 is used to secure the accessory 40 with respect to the riser 12.

Figure 3:
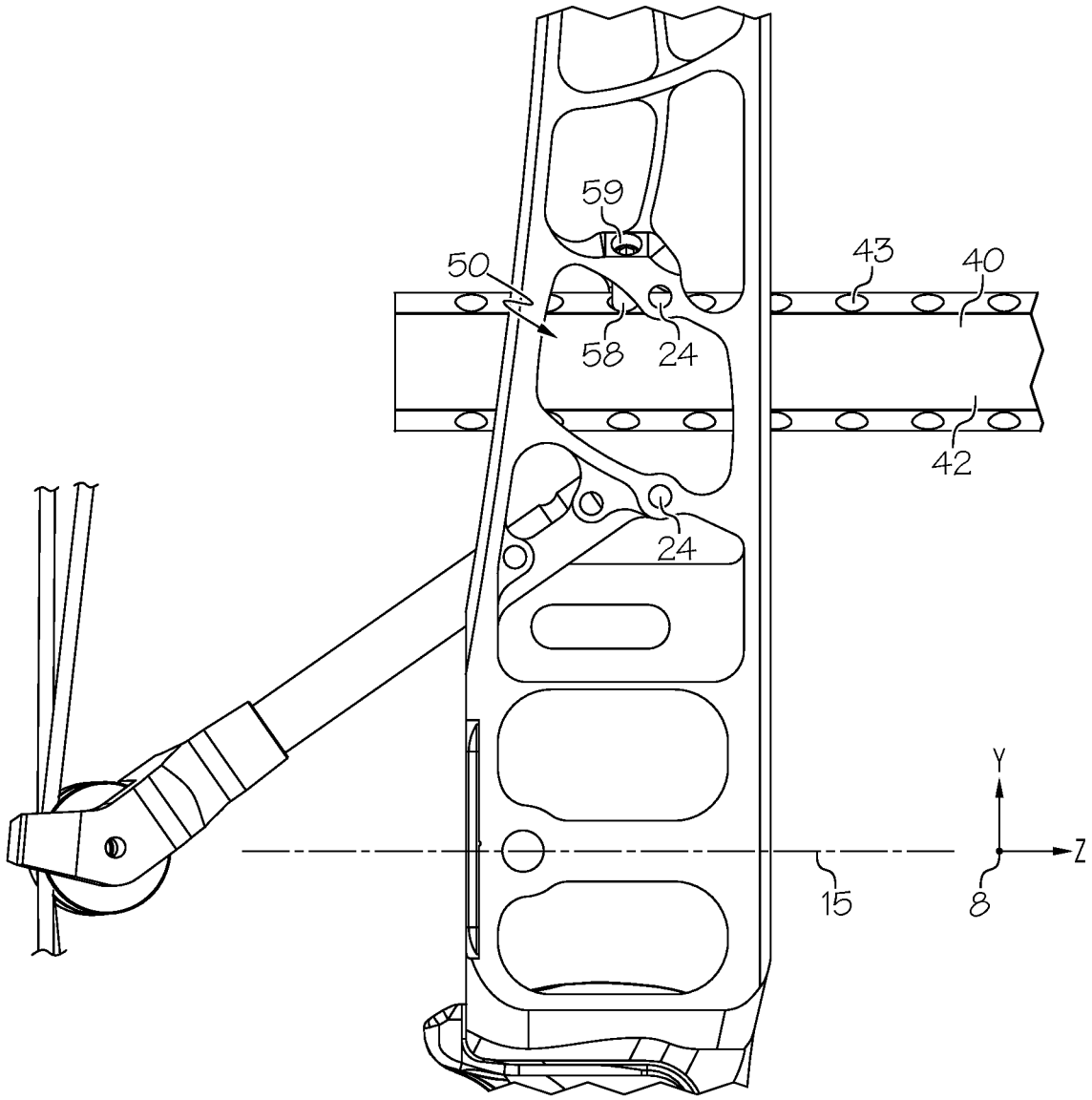
FIG. 3 shows a detail of an embodiment of a riser.

FIG. 3 shows an embodiment of a riser 12 and an embodiment of an accessory 40 in greater detail. In some embodiments, a riser 12 comprises a pair of sight mount apertures 40, which can be used to attach a mounting bracket to the riser 12 that can support a sight. In some embodiments, the riser 12 further comprises a cavity 50 as described herein for receiving an accessory 40, such as a sight.

In some embodiments, an accessory 40 comprises a mounting bar 42. In some embodiments, a mounting bar 42 comprises a trapezoidal cross-sectional shape. In some embodiments, a mounting bar 42 comprises a plurality of detents 43 spaced along its length. In some embodiments, a detent 43 comprises a notch or cavity formed in an outer surface of the mounting bar 42.

In some embodiments, a mounting bar 42 comprises a known device such as a "dovetail bar," which can be used to mount bow sights. In some embodiments, the cavity 50 formed in the riser 12 comprises specific features that allow the riser 12 to properly engage and support various embodiments of mounting bars 42, which may vary with respect to one another, for example comprising different specific dimensions, materials, etc.

In some embodiments, the riser 12 is configured to engage a fastener 58 arranged to tighten against the accessory 40. In some embodiments, the riser 12 comprises a threaded cavity 59 arranged to receive and engage the fastener 58. In some embodiments, the fastener 58 is arranged to extend into the cavity 50. In some embodiments, the fastener 58 engages a detent 43 of the accessory 40.

In some embodiments, the fastener 58, and the threaded cavity 59, are oriented at a non-zero, non-orthogonal angle to one or more of the three mutually perpendicular coordinate axes 8. For example, if a shooting axis 15 of the bow 10 extends along a z-axis, then the fastener 58 shown in FIG. 3 is oriented at a non-zero angle to the x-axis and to the y-axis. In some embodiments, the fastener 58, and the threaded cavity 59, are oriented at a non-zero, non-orthogonal angle to at least two of the three mutually perpendicular coordinate axes 8.

Figure 4:
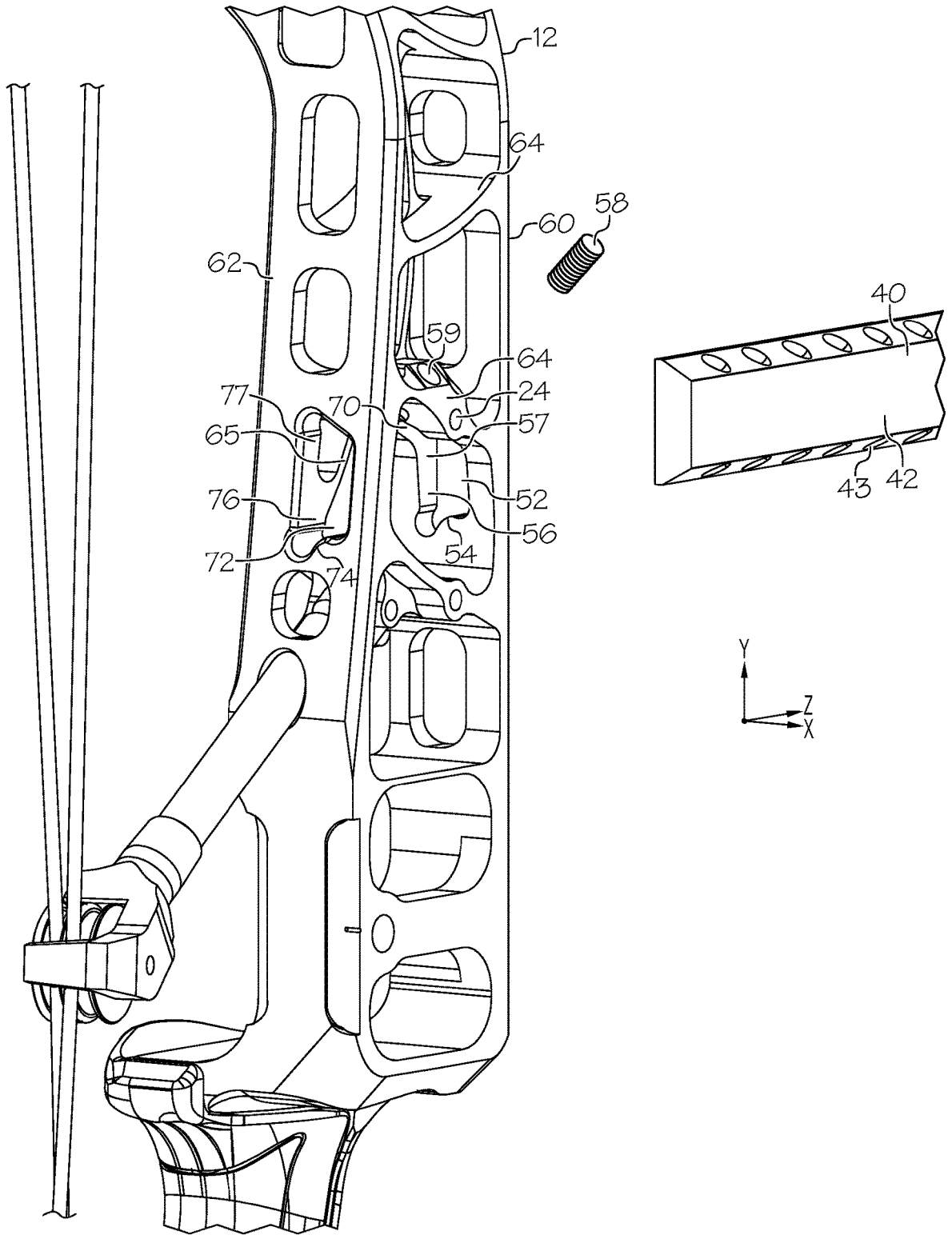
FIG. 4 shows another view of an embodiment of a riser.

FIG. 4 shows an embodiment of a cavity 50 is greater detail. In some embodiments, a riser 12 comprises integral structural members and various cells. In some embodiments, a riser 12 comprises a first rail 60 defining a first surface (e.g. front surface) of the riser 12 and a second rail 62 defining a second surface (e.g. rear surface) of the riser 12. In some embodiments, under the loading experienced in a brace condition of the bow 10, the first rail 60 comprises a tension rail and the second rail 62 comprises a compression rail.

In some embodiments, the riser 12 comprises a plurality of connecting members 64. In some embodiments, connecting members 64 extend between the first rail 60 and the second rail 62. In some embodiments, a connecting member 64 extends between a rail 60, 62 and another connecting member 64. In some embodiments, a connecting member 64 extends between other connecting members 64.

In some embodiments, a connecting member 64 comprises the threaded cavity 59. In some embodiments, a connecting member 64 comprises a sight mount aperture 24. In some embodiments, a connecting member 64 comprises a sight mount aperture 24 and the threaded cavity 59. In some embodiments, a central axis of a sight mount aperture 24 is oriented non-parallel to a central axis of the threaded cavity 59.

In some embodiments, the cavity 50 comprises a first aperture 52 formed in the first rail 60. In some embodiments, the first aperture 52 comprises a plurality of support portions arranged to support an accessory 40. In some embodiments, the first aperture 52 comprises a first support portion 54. In some embodiments, the first aperture 52 comprises a second support portion 56 spaced apart from the first support portion 54. In some embodiments, the first aperture 52 comprises a third support portion 57 spaced apart from the first support portion 54 and the second support portion 56.

In some embodiments, the riser 12 comprises a planar support surface 70 arranged to support an accessory 40. In some embodiments, the second support portion 56 and the third support portion 57 are oriented on the planar support surface 70.

In some embodiments, the cavity 50 comprises a second aperture 72 formed in the second rail 62. In some embodiments, the second aperture 72 comprises a plurality of support portions arranged to support an accessory 40. In some embodiments, the second aperture 72 comprises a first support portion 74. In some embodiments, the second aperture 72 comprises a second support portion 76 spaced apart from the first support portion 74. In some embodiments, the second aperture 72 comprises a third support portion 77 spaced apart from the first support portion 74 and the second support portion 76.

In some embodiments, the second support portion 76 and the third support portion 77 of the second aperture 72 are oriented on the planar support surface 70.

In some embodiments, a connecting member 64 comprises a connector support portion 65 arranged to support an accessory 40. In some embodiments, the connector support portion 65 is oriented on the planar support surface 70.

In some embodiments, the first support portion 54 of the first aperture 52 comprises curvature. In some embodiments, the first support portion 54 is convex with respect to the first aperture 52. In some embodiments, a cross-section of the first aperture 52 (e.g. in an x-y plane) comprises a first support portion 54 comprising curvature. In some embodiments, the first support portion 54 comprises a surface that is straight along a line orthogonal to the cross-section (e.g. straight along the z-axis).

In some embodiments, a length of the first support portion 54, 74 as measured along the z-axis is greater than a distance across a detent 43 of the accessory 40.

In some embodiments, the first support portion 54 of the first aperture 52 and the first support portion 74 of the second aperture 72 comprise similar shapes. In some embodiments, a shape of the first aperture 52 is similar to a shape of the second aperture 72.

Figure 5:
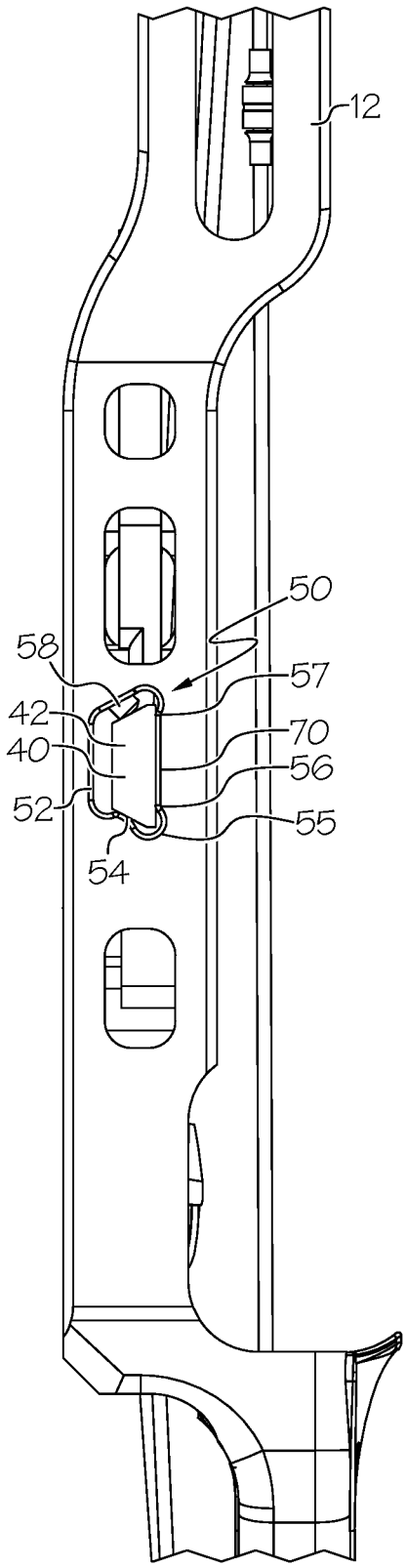
FIG. 5 shows another view of an embodiment of a riser.
Figure 6:
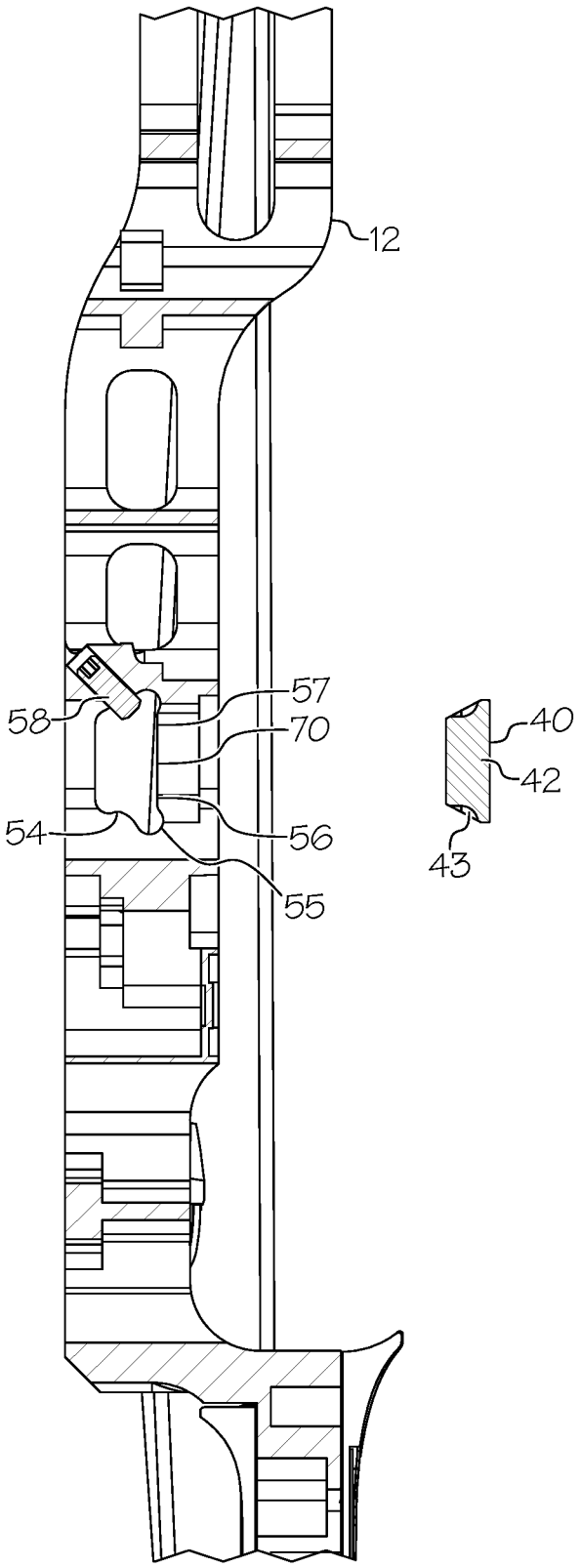
FIG. 6 shows a cross-sectional view of an embodiment of a riser.

FIG. 5 shows an embodiment of a mounting bar 42 of an accessory 40 oriented in a cavity 50 in a riser 12. FIG. 6 shows a cross-sectional view of a riser 12. In some embodiments, a first support portion 54, 74 and a second support portion 56, 76 are arranged to self-align an accessory 40 with respect to the riser 12 when loaded by the fastener 58. In some embodiments, the accessory 40 contacts portions of the support portions 54, 56 that comprise diverging surfaces. In some embodiments, the accessory 40 contacts portions of the support portions 54, 56 having tangents that are diverging. In some embodiments, the fastener 58 is located within an angle defined by the support portions 54, 56.

In some embodiments, an accessory 40 contacts a first support portion 54, a second support portion 56 and a third support portion 57 of a riser 12 but does not contact any other portion of the first aperture 52. In some embodiments, an accessory 40 contacts a first support portion 54 and a planar surface 70 but does not contact any other portion of the first aperture 52.

In some embodiments, the first aperture 52 comprises an enlarged portion 55 located between the first support portion 54 and the second support portion 56. In some embodiments, the enlarged portion 55 does not contact an accessory 40 oriented in the first aperture 52. In some embodiments, the enlarged portion 55 is concave with respect to the first aperture 52.

In some embodiments, an aperture 52, 72 comprises an asymmetrical cross-sectional shape. In some embodiments, the cross-sectional shape of an aperture 52, 72 is asymmetrical across a first axis, for example an axis parallel to the bowstring or a vertical axis. In some embodiments, the cross-sectional shape of an aperture 52, 72 is asymmetrical across a second axis that is orthogonal to the first axis, for example a horizontal axis. In some embodiments, a center of the first aperture 52 is aligned with a center of the second aperture 72 on a third axis that is orthogonal to both the first axis and the second axis. In some embodiments, the third axis is parallel to a shooting axis defined by the bow. In some embodiments, the shooting axis is colinear with an arrow launch vector.

Figure 7:
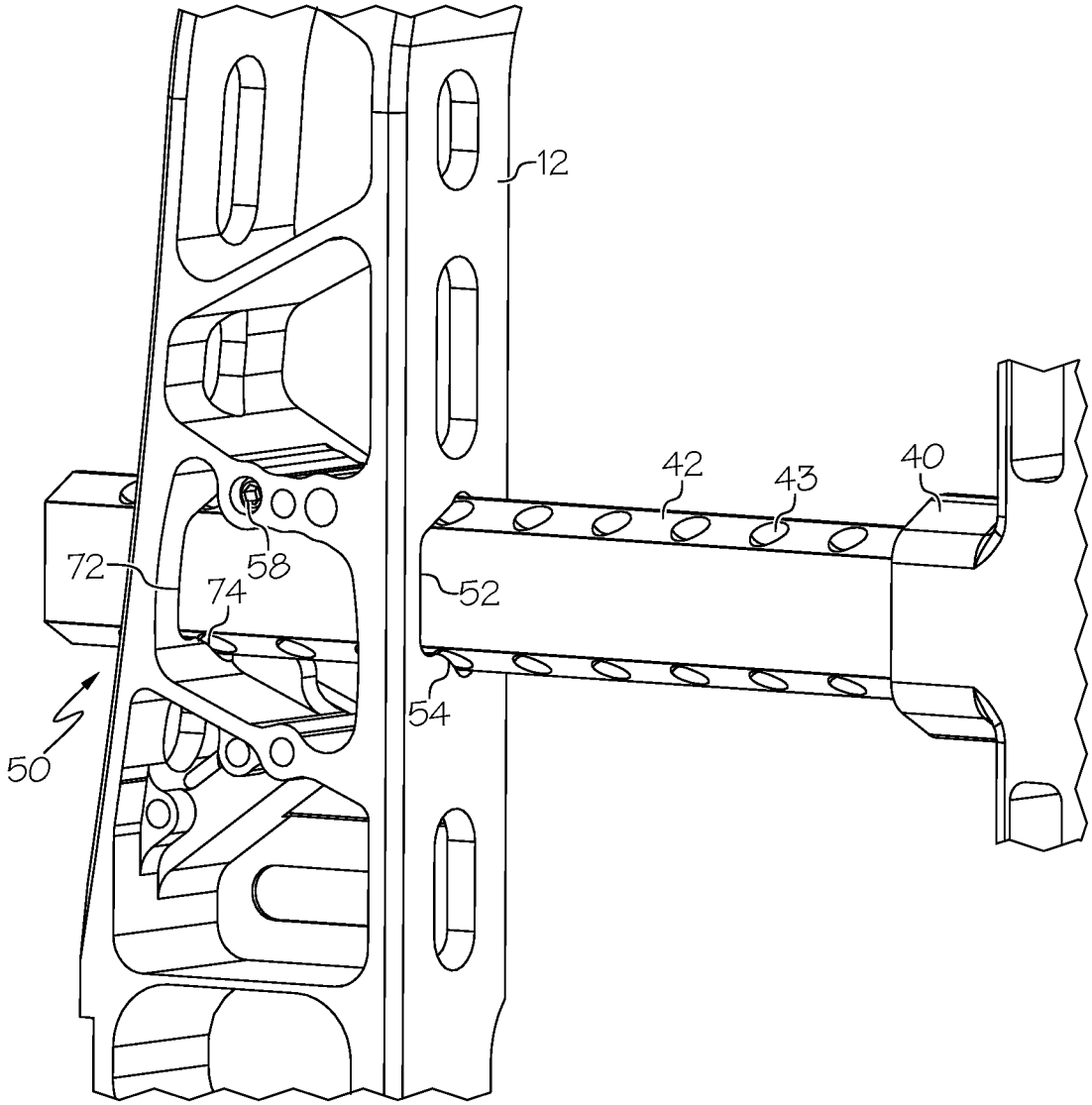
FIGS. 7 and 8 show another embodiment of a riser.
Figure 8:
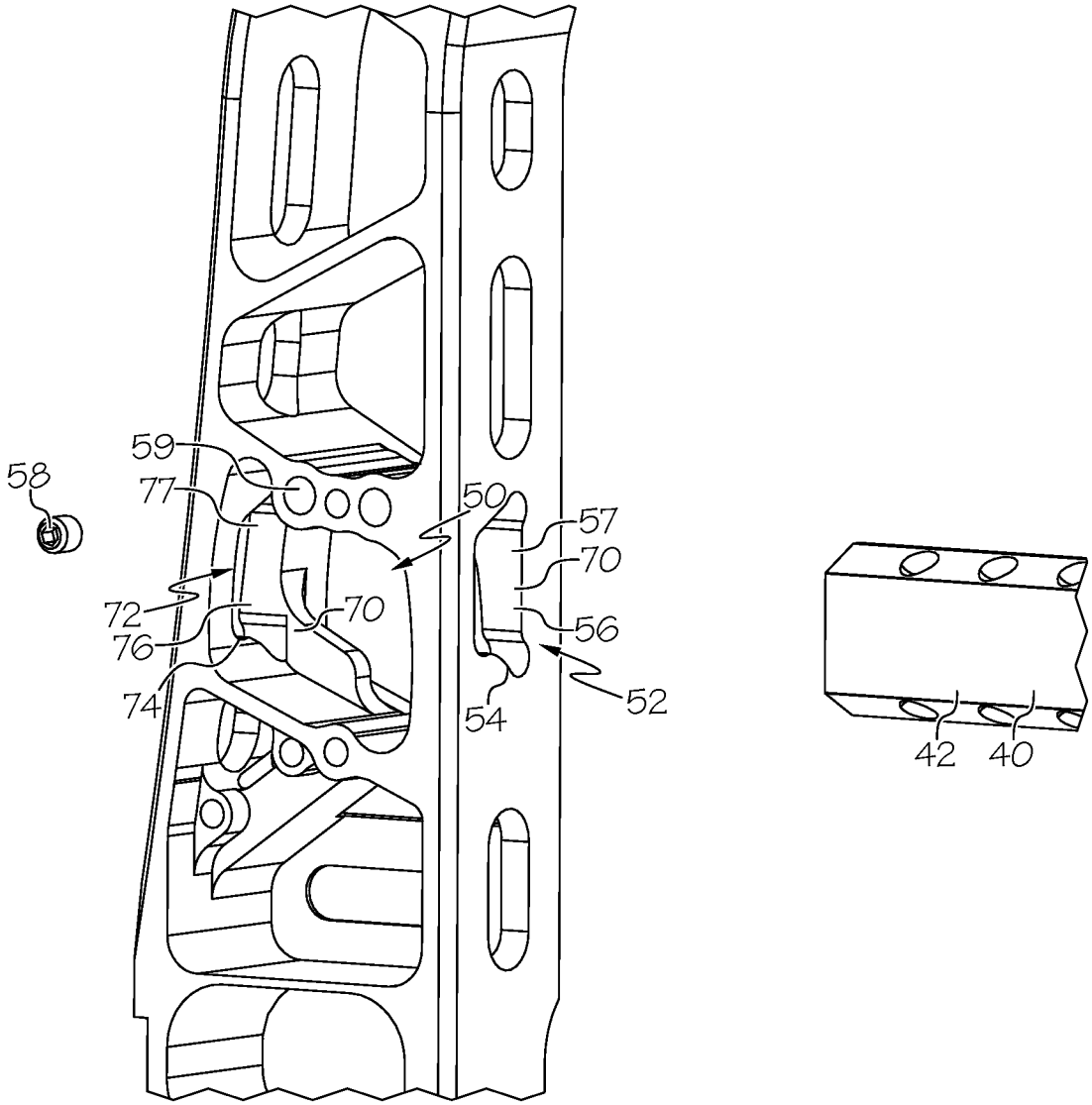

FIGS. 7 and 8 show another embodiment of a riser 12 arranged to receive an accessory 40 in a cavity 50.

In some embodiments, a riser 12 comprises a single piece of material. In some embodiments, the first rail 60 and the second rail 62 comprise the single piece of material. In some embodiments, a connecting member 64 also comprises the single piece of material.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:

a riser, a first limb assembly, a second limb assembly and a bowstring;

the riser comprising a first rail and a second rail, the first rail comprising a tension rail of the archery bow, the second rail comprising a compression rail of the archery bow, the first rail comprising a first aperture, the first rail fully surrounding the first aperture;

a sight comprising a mounting bar, the mounting bar extending through the first aperture and contacting the riser; and a fastener attaching the mounting bar to the riser;

wherein a shooting axis of the archery bow does not pass through the first aperture.

2. The archery bow of claim 1, the fastener located between the first rail and the second rail.

3. The archery bow of claim 1, the riser comprising a threaded cavity, a portion of the fastener oriented in the threaded cavity.

4. The archery bow of claim 3, the riser comprising a connecting member extending between the first rail and the second rail, the connecting member comprising the threaded cavity.

5. The archery bow of claim 4, the first rail, the second rail and the connecting member comprising a single piece of material.

6. The archery bow of claim 1, the riser comprising a connecting member extending between the first rail and the second rail, the connecting member comprising a planar support surface.

7. The archery bow of claim 1, the second rail comprising a second aperture, the mounting bar extending through the second aperture.

8. The archery bow of claim 7, wherein the first aperture and the second aperture comprise a similar shape.

9. The archery bow of claim 1, wherein the fastener is the only fastener contacting both the riser and the mounting bar.

10. The archery bow of claim 1, comprising a shooting axis, the fastener comprising a central axis, the central axis orthogonal to the shooting axis.

11. The archery bow of claim 1, the mounting bar comprising a first detent and a second detent, the fastener arranged to engage the first detent with the mounting bar in a first position, the fastener arranged to engage the second detent with the mounting bar in a second position.

12. The archery bow of claim 1, the riser comprising diverging surfaces arranged to contact the mounting bar.

13. The archery bow of claim 12, the mounting bar comprising complimentary diverging surfaces arranged to contact the diverging surfaces of the riser.

14. The archery bow of claim 1, the shooting axis comprising a z-axis, the first aperture offset from the shooting axis by a distance along a y-axis.

15. The archery bow of claim 14, the first aperture offset from the shooting axis by a distance along an x-axis.

16. The archery bow of claim 15, the fastener comprising a central axis, the central axis parallel to the x-axis.

17. The archery bow of claim 1, the first aperture comprising an area, the mounting bar occupying a majority of the area.

18. An archery bow comprising:

a riser comprising a first rail, a second rail and a cavity, the first rail comprising a tension rail of the archery bow, the second rail comprising a compression rail of the archery bow, the cavity located between the first rail and the second rail;

a sight comprising a mounting bar, the mounting bar extending through the first rail, the cavity and the second rail, the first rail fully surrounding the mounting bar; and a fastener attaching the mounting bar to the riser;

wherein a shooting axis of the archery bow does not pass through the first rail.

19. The archery bow of claim 18, the riser comprising diverging surfaces arranged to contact the mounting bar.

20. The archery bow of claim 19, the mounting bar comprising complimentary diverging surfaces arranged to contact the diverging surfaces of the riser.

21. The archery bow of claim 18, the mounting bar comprising a first detent and a second detent, the fastener arranged to engage the first detent with the mounting bar in a first position, the fastener arranged to engage the second detent with the mounting bar in a second position.

22. The archery bow of claim 18, comprising a shooting axis extending adjacent to the first rail and the second rail.

23. The archery bow of claim 18, wherein the first rail and the second rail are integrally formed.

24. An archery bow comprising:

a riser comprising a single piece of material comprising a first rail, a second rail and a connecting member, the first rail comprising a first aperture, the first rail fully surrounding the first aperture, the connecting member comprising a threaded cavity;

a sight comprising a mounting bar, the mounting bar extending through the first aperture; and a fastener attaching the mounting bar to the riser, the fastener engaging the threaded cavity.

25. The archery bow of claim 24, the second rail comprising a second aperture, the mounting bar extending through the second aperture.

26. The archery bow of claim 24, the mounting bar comprising a first detent and a second detent, the fastener arranged to engage the first detent with the mounting bar in a first position, the fastener arranged to engage the second detent with the mounting bar in a second position.

27. The archery bow of claim 24, the single piece of material comprising a plurality of cells.

28. The archery bow of claim 24, wherein a shooting axis of the archery bow does not pass through the first aperture.

* * * * *